US007207739B1

(12) United States Patent
Preteroti

(10) Patent No.: US 7,207,739 B1
(45) Date of Patent: Apr. 24, 2007

(54) DISPENSER OF PERSONAL CARE MATERIAL

(76) Inventor: Dennis Preteroti, 130 Lakeside Rd., Hewitt, NY (US) 07421

( * ) Notice: Subject to any disclaimer, the term of this patent is extended or adjusted under 35 U.S.C. 154(b) by 0 days.

(21) Appl. No.: 11/484,000

(22) Filed: Jul. 10, 2006

(51) Int. Cl.
*B43K 5/06* (2006.01)
*B43K 21/08* (2006.01)

(52) U.S. Cl. ..... 401/175; 401/68; 401/75; 401/172; 222/390

(58) Field of Classification Search ..... 401/55, 401/59, 60, 63, 64, 68, 72, 75, 82, 84, 132, 401/179, 171–176; 222/39, 387, 390, 391
See application file for complete search history.

(56) References Cited

U.S. PATENT DOCUMENTS 4,169,547 A * 10/1979 Newell ..... 401/176
4,545,696 A * 10/1985 Carluccio ..... 401/175
4,915,528 A * 4/1990 Seager ..... 401/68
5,944,434 A * 8/1999 Schlatter ..... 401/82

* cited by examiner

*Primary Examiner*—Tuan Nguyen

(57) ABSTRACT

A dispenser of personal care material employs a vertical hollow circular cylinder having a vertical axis and open at upper and lower ends. Upper and lower caps are secured and are detachably sealed to upper and lower ends of the cylinder.

10 Claims, 2 Drawing Sheets

DISPENSER OF PERSONAL CARE MATERIAL

FIELD OF THE INVENTION

This invention is directed toward dispensers containing inserts of personal care material.

BACKGROUND OF THE INVENTION

Dispensers generally of cylindrical shape contain vertical inserts of personal material and have removable top caps which expose the top end of the insert and bottom caps which are manually rotated to continually raise the insert as portions are used up by applications to the body of a user. This process continues until the insert has been fully consumed at which point the dispenser is thrown away and replaced by a new dispenser containing an unused insert.

These dispensers before initial use must be air tight because once the personal material is exposed to air it begins to deteriorate and the dispenser must then be used. Known types of dispensers if stored before use for some period of time will ultimately leak and permit air exposure whereby they can no longer be used.

In this invention, the dispensers have been so constructed that they cannot leak prior to initial use even if stored for use for extended periods prior to initial use.

SUMMARY OF THE INVENTION

In accordance with the teachings of this invention, a dispenser of personal care material employs a vertical hollow circular cylinder having a vertical axis and open at upper and lower ends. An upper cap assembly is removably secured to the upper end of the cylinder to produce an air tight upper end seal. A vertical elongated threaded drive screw is disposed within the cylinder and is spaced from both ends of the cylinder. The screw is disposed along the cylindrical axis.

A horizontal elevator cup has a central opening threadedly engaging the drive screw whereby when the drive screw rotates in one direction member is raised and when the drive assembly rotates in opposite direction the member is lowered.

An inset of personal material can be inserted in the cylinder with the drive screw extending through and engaging the insert in intimate contact.

A lower cap assembly includes a lower end cap rotatably secured to the lower end of the cylinder. The lower end cap has a centrally disposed opening.

A disc that is movable in the lower cap assembly is disposed in said opening. The disc has an inwardly projecting vertical prong which exhibits an additional forward motion when the disc is manually pressed inward. The disc engages the end cap and is rotatable therewith.

Air tight seal means disposed in the cylinder below the lower end of the screw assembly and above the prong includes a seal cap disposed rotatably in the lower end cap. The seal cap has a valve seal. The seal has a panel with a hole covered by a sealing film enclosing the open lower end of the cylinder. When the film is sealed to the open end of the cylinder, a lower end air tight seal is produced. The prong when moved forward penetrates the plate and film and destroys the air seal. The prong thereafter remains in locked engagement with the lower end of the drive screw and the penetrated plate.

The disc rotates with the end cap. As the disc rotates, the prong is rotated and rotates the drive screw to raise or lower the elevator cup. An insert is mounted on the cup with the screw extending there through and is raised and lowered with the cup.

As a consequence of this construction, the dispenser will not leak air even when stored prior to use for an extended period.

Additional objects and advantages of this invention will either be explained or will become apparent hereinafter.

DETAILED DESCRIPTION OF PREFERRED EMBODIMENTS

Figure 1:
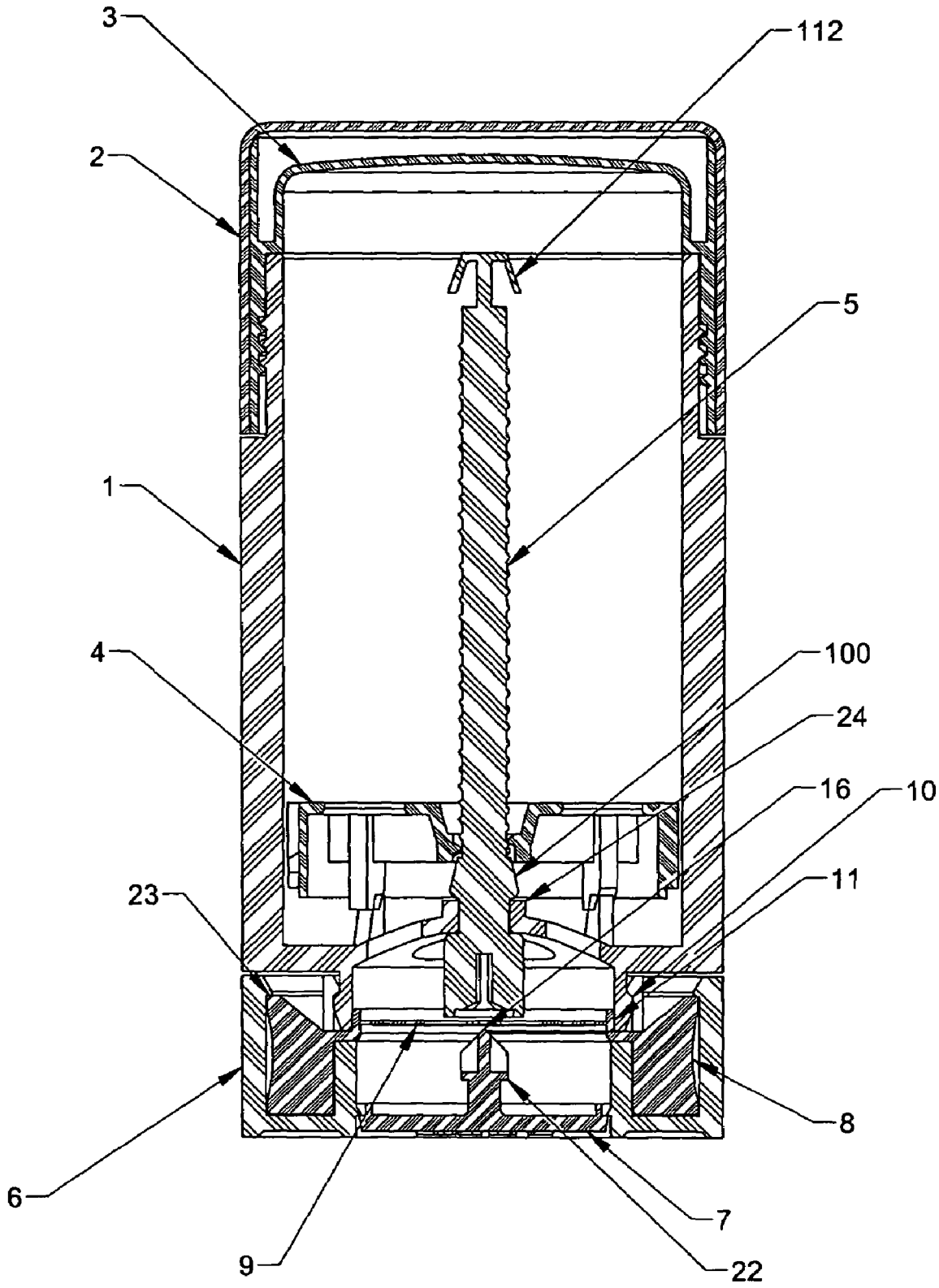
FIG. 1 is a vertical cross-sectional view of a preferred embodiment of the invention.
Figure 2:
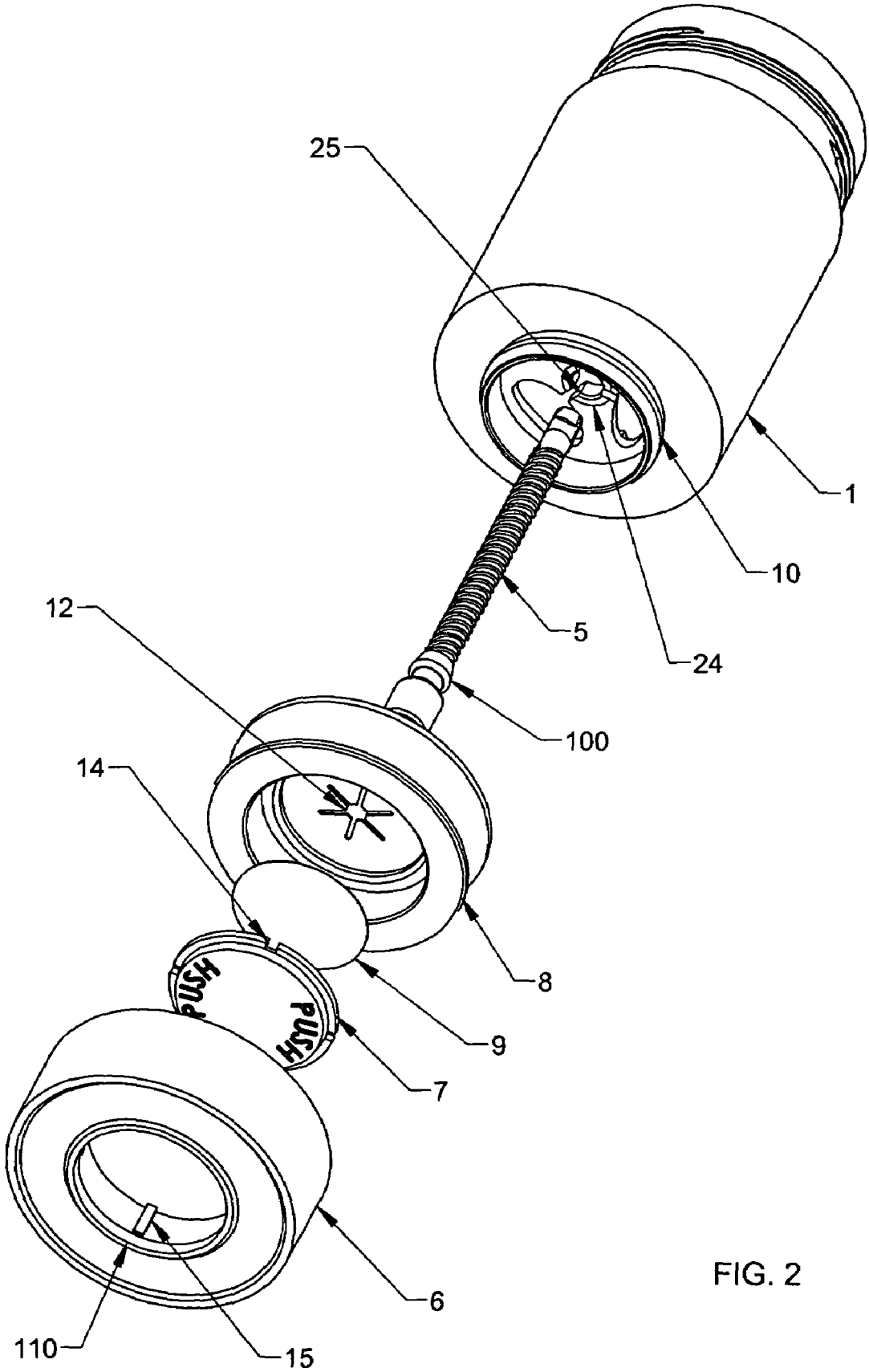
FIG. 2 is an exploded view of the embodiment of FIG. 1.

FIGS. 1 and 2 show a hollow vertical cylinder 1 with an upper cap 2 removably screwed to the open top end of the cylinder in air tight engagement. A smaller cap 3 is disposed within and is secured to the cap 2. A drive screw 5 is disposed in the cylinder along its axis and is spaced from both its ends. The lower end of the screw has an opening which conforms to the shape of the vertical prong 16 of plate 7.

A lower cap assembly includes a base cap 6 rotatably secured to the reduced open circular end 10 of the cylinder. The base cap has a centrally disposed opening 110 therein.

A push plate 7 is movably disposed in said opening. The plate 7 has an inwardly projecting vertical prong 16 which will exhibit an additional forward motion when the disc is manually pressed inward. The plate 7 has four slots 14 around its periphery which engage four ribs 15 in the cap 6 so that when cap 6 is rotated, plate 7 will rotate with it.

Seal cap 8 has a round valve seal 11. The face of the seal 11 is a thin walled panel with a star shaped hole 12 which is sealed by a foil induction like seal 9. Seal cap 8 is snapped into base cap 6 that has an under cut 23 around its open front.

Push plate 7 has an inward prong 16 shaped to penetrate hole 12. When the plate 7 is pushed inward, prong 16 pierces seal 9 and passes through hole 12 to engage the opening in the lower end of the drive screw. The plate is locked into this engagement by the hole 12 in the seal cap 8. When base cap 6 is rotated, the push plate rotates therewith and rotates the screw, Spaced upwardly inclined ribs 25 extend from the lowered circular end 10 of the cylinder to a threaded circular core 24 threadedly engaged by screw 5. A portion 100 of the screw immediately above the core is enlarged. A horizontal elevator cup 4 is threadedly engaged by the screw and is raised or lowered by screw rotation. The portion 100 establishes a protective lower limit for cup movement. When the cup is raised to its desired upper limit, a protective cap 112 on the upper end of the screw engages the cup and prevents further upward movement.

While the invention has been described in detail with reference to the drawings and detailed description, the protection solicited is to be limited only by the terms of the claims that follow.

What is claimed is:

1. A dispenser of personal care material adapted to receive and store an insert of personal material and comprising:

a vertical hollow circular cylinder having a vertical axis and open at upper and lower ends;

an upper cap assembly removably secured to the upper end of the cylinder to produce an air tight upper end seal;

a vertical elongated threaded drive screw disposed within the cylinder and spaced from both cylindrical ends, said screw being disposed along the cylindrical axis;

a lower cap assembly including a lower end cap rotatably secured to the lower end of the cylinder, said lower end cap having a centrally disposed opening;

a disc that is disposed in said opening, said disc having an inwardly projecting vertical prong which will exhibit an additional forward motion when the disc is manually pressed inward, the disc being engaged with and rotatable with the end cap;

air tight seal means disposed in the cylinder below the lower end of the screw assembly and above the prong, said means including a sealing film which encloses the open lower end of the cylinder and produces a lower end air tight seal, the seal being destroyed when the film is penetrated by the prong.

2. The dispenser of claim 1 further including a horizontal elevator cup having a central opening threadedly engaging the drive screw whereby when the drive screw rotates in one direction the member is raised and when the drive assembly rotates in opposite direction the member is lowered.

3. The dispenser of claim 2 wherein the prong after forward movement is disposed in locking engagement with the lower end of the drive screw, thus causing the screw to be rotated by rotation of disc and end cap.

4. The dispenser of claim 3 wherein said cup has a maximum raised position and a minimum lowered position.

5. The dispenser of claim 4 having means to prevent the cup from being raised above said maximum.

6. The dispenser of claim 4 having means to prevent the cup from being lowered below said minimum.

7. The dispenser of claim 4 having means to prevent the cup from being raised above said maximum and having means to prevent the cup from being lowered below said minimum.

8. The dispenser of claim 1 wherein said air tight seal means includes a seal cap having a round valve seal.

9. The dispenser of claim 8 wherein the face of the round seal is a thin walled panel with a shaped hole which is sealed by said film seal.

10. The dispenser of claim 9 wherein the hole has the shape of a star.

* * * * *